US011034471B1

(12) United States Patent
Frisch

(10) Patent No.: US 11,034,471 B1
(45) Date of Patent: Jun. 15, 2021

(54) FILM-WRAPPING APPARATUS AND METHOD

(71) Applicant: SPRINGER MASCHINENFABRIK GMBH, Friesach (AT)

(72) Inventor: Clemens Frisch, Neumarkt (AT)

(73) Assignee: SPRINGER MASCHINENFABRIK GMBH, Friesach (AT)

( * ) Notice: Subject to any disclaimer, the term of this patent is extended or adjusted under 35 U.S.C. 154(b) by 0 days.

(21) Appl. No.: 17/051,957

(22) PCT Filed: Apr. 29, 2019

(86) PCT No.: PCT/EP2019/060891
§ 371 (c)(1),
(2) Date: Oct. 30, 2020

(87) PCT Pub. No.: WO2019/211228
PCT Pub. Date: Nov. 7, 2019

(30) Foreign Application Priority Data

May 2, 2018 (AT) ..... A 50369/2018

(51) Int. Cl.
*B65B 11/08* (2006.01)
*B65B 49/14* (2006.01)
(Continued)

(52) U.S. Cl.
CPC ..... *B65B 11/08* (2013.01); *B65B 41/14* (2013.01); *B65B 49/14* (2013.01); *B65B 49/16* (2013.01); *B65B 51/14* (2013.01); *B65B 61/10* (2013.01)

(58) Field of Classification Search
CPC ..... B65B 11/00; B65B 11/06; B65B 11/08; B65B 11/12; B65B 41/00; B65B 41/12;
(Continued)

(56) References Cited

U.S. PATENT DOCUMENTS 3,344,577 A * 10/1967 Harm ..... B65B 61/10 53/373.5
3,619,970 A 11/1971 Zelnick
(Continued)

FOREIGN PATENT DOCUMENTS

CA 2936043 A1 * 8/2015 ..... B65B 11/08
DE 6928682 U 6/1974
(Continued)

OTHER PUBLICATIONS

International Application No. PCT/EP2019/060891, International Search Report and Written Opinion dated Jul. 22, 2019, 15 pages.
(Continued)

*Primary Examiner* — Stephen F. Gerrity
(74) *Attorney, Agent, or Firm* — Liang & Hennessey LLP; Brian Hennessey

(57) ABSTRACT

A film-wrapping apparatus for the automatic film-wrapping of articles is provided that includes a conveying device for conveying an article through a film-wrapping channel of the film-wrapping apparatus. The film-wrapping apparatus has a film-supply device arranged above the film-wrapping channel. The film-wrapping apparatus also includes at least two movably arranged grippers and a sealing device. The at least two grippers are predefinably movably arranged between a supply position and a sealing position. The grippers, in the supply position, grip two opposite corners of the film material supplied by the film-supply device and pull the film material from the supply position into the sealing position and hold the material. In the sealing position, the grippers are arranged in a sealing plane and substantially level with an upper side of the conveying device. The sealing device seals the two side edges of the article that are arranged in the sealing plane.

21 Claims, 7 Drawing Sheets

(51) Int. Cl.
*B65B 49/16* (2006.01)
*B65B 51/14* (2006.01)
*B65B 61/10* (2006.01)
*B65B 41/14* (2006.01)

(58) Field of Classification Search
CPC ..... B65B 41/14; B65B 49/14; B65B 49/16; B65B 51/10; B65B 51/14; B65B 51/30; B65B 51/303; B65B 61/10
USPC ..... 53/203, 220, 228, 397, 389.2, 461, 463, 53/466, 580
See application file for complete search history.

(56) References Cited

U.S. PATENT DOCUMENTS 3,643,396 A * 2/1972 Togashi et al. ..... B65B 9/026 53/463
3,667,598 A 6/1972 Zelnick et al.
4,078,363 A * 3/1978 Ranzi ..... B65B 11/54 53/228
4,231,210 A * 11/1980 Nagode ..... B65B 11/08 53/580
5,657,608 A * 8/1997 Parviainen et al. .... B65B 11/10 53/465
6,279,295 B1 * 8/2001 Girard et al. ..... B65B 11/02 53/397
8,534,033 B2 * 9/2013 Perreault et al. ..... B65B 41/14 53/397
9,033,629 B2 5/2015 Payne
2012/0085072 A1 * 4/2012 Deschenes ..... B65B 11/02 53/461
2013/0298498 A1 * 11/2013 Imamaki et al. ..... B65B 11/06 53/203

FOREIGN PATENT DOCUMENTS

EP 2433874 A1 3/2012
JP 54135093 A * 10/1979
JP 2000118506 A 4/2000
JP 2017036071 A 2/2017
KR 20110089911 A 8/2011
WO 2016208230 A1 12/2016

OTHER PUBLICATIONS

Austria Application No. A 50369/2018, Office Action dated Mar. 7, 2019, 2 pages.

* cited by examiner

Fig. 10
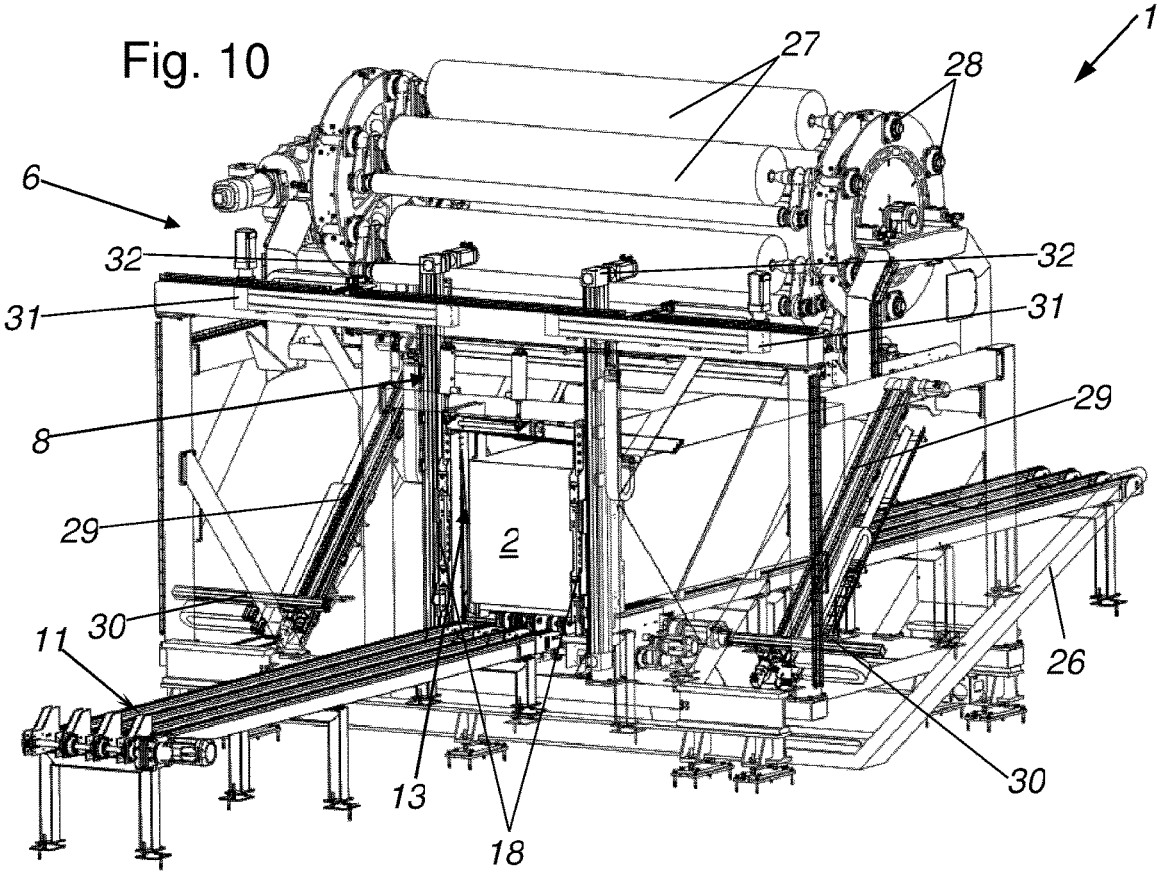
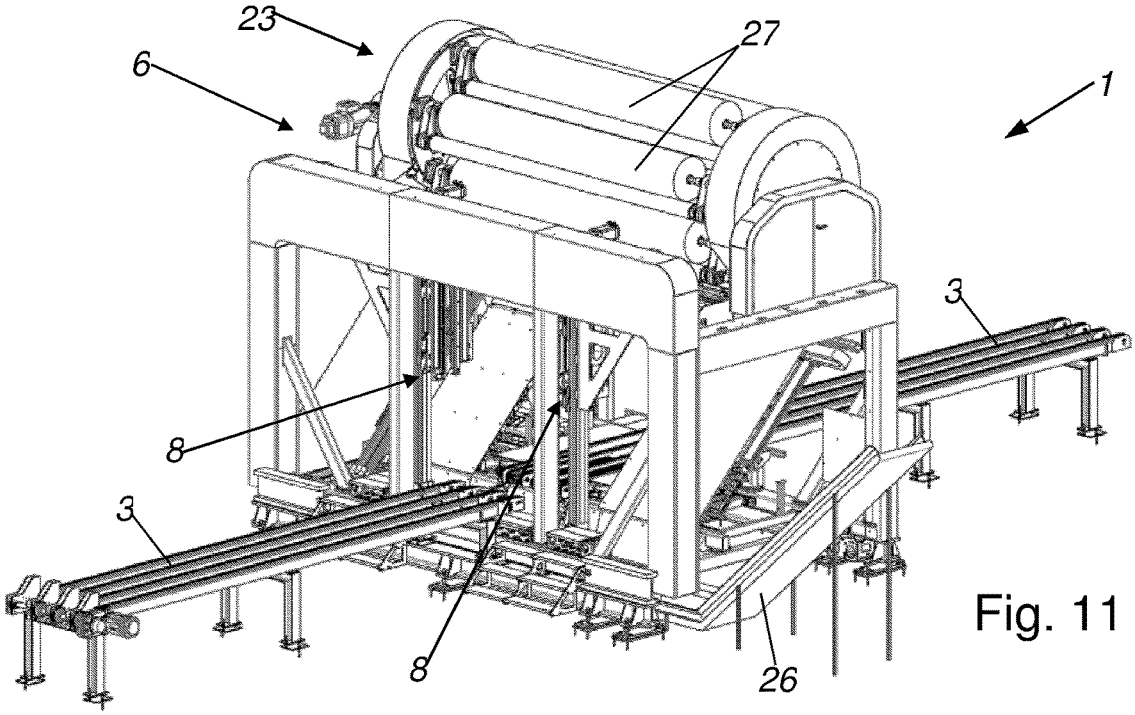
Fig. 11

FILM-WRAPPING APPARATUS AND METHOD

CROSS-REFERENCE TO RELATED APPLICATIONS

The present application is a national phase application of PCT Application No. PCT/EP2019/060891, filed Apr. 29, 2019, entitled "FILM-WRAPPING APPARATUS", which claims the benefit of Austrian Patent Application No. A 50369/2018, filed May 2, 2018, each of which is incorporated by reference in its entirety.

BACKGROUND OF THE INVENTION

1. Field of the Invention

The invention relates to a film-wrapping apparatus for fully automatic film-wrapping of articles.

2. Description of the Related Art

Film-wrapping apparatuses are used to cover or wrap articles with a film. In sawn timber production plants, for example, the articles are mainly packed manually or semi-automatically, wherein plastic or light-metal staples or nails for positioning or fixing the film are usually used as aids. Automatic film-wrapping apparatuses often use film hoods to film-wrap articles.

Usually, the film is applied to the articles to be film-wrapped and provided with a strapping or placed over the articles as a prefabricated film hood and then fixed with staples or nails or an additional strapping band. The adaptation of the film to the different dimensions of the articles is usually carried out by changing the film in a film dispenser.

The disadvantage of such film-wrapping apparatuses is that prefabricated film hoods always require the same dimensions of the articles, which is why film hoods do not allow flexibility with regard to the dimensions of the articles. In order to adapt the film to the respective dimensions of the articles, the film dispenser has to be converted in a time-consuming way. Furthermore, automatic film-wrapping apparatuses usually require a large amount of space and/or they require complicated and elaborate mechanics as well as increased processing times. Manual and semi-automatic film-wrapping processes are not only cumbersome and tedious, but due to various steps requiring the use of personnel, they are also correspondingly labor-, cost- and time-intensive.

It is therefore the object of the invention to specify a film-wrapping apparatus of the type mentioned above, with which the disadvantages mentioned can be avoided, with which a simple, space-saving and fully automatic film-wrapping of articles can be accomplished.

SUMMARY OF THE INVENTION

According to the invention this is achieved by the features described herein. In particular, the present technology provides a film-wrapping apparatus for the automatic film-wrapping of articles which includes a conveying device for conveying an article through a film-wrapping channel of the film-wrapping apparatus. The film-wrapping apparatus has a film-supply device for supplying film for film-wrapping the article, which film-supply device is arranged above the film-wrapping channel when viewed in the operating position. The film-wrapping apparatus further includes at least two movably arranged grippers and a sealing device, wherein the at least two grippers are arranged so as to be predeterminably movable between a supply position and a sealing position. The grippers are designed to grip the film supplied by the film-supply device in the supply position at two opposite corners and to pull the film from the supply position to the sealing position and hold the film. The grippers in the sealing position are arranged in a sealing plane and essentially at the height of an upper side of the conveying device. The sealing device is designed to seal both side edges of the article arranged in the sealing plane and sheathed by the film.

This has the advantage that the film-wrapping process is uncomplicated and is carried out in a fully automatic manner. This relieves the operating personnel, since no human work steps are necessary for the film-wrapping of the articles and correspondingly, staff costs can be saved. Furthermore, a simple, reliable and fully continuous operation of the film-wrapping apparatus is possible. Due to the automation, the efficiency of the film-wrapping apparatus is also increased. Furthermore, there is the advantage that no fixing elements such as staples or nails are needed to position and/or fix the film on the article, which enables optically appealing results of high quality. As the available space in various plants and production rooms is often very limited, another advantage of the film-wrapping apparatus is that the film-wrapping apparatus can be designed shorter than the articles to be film-wrapped. Due to its space-saving design, the film-wrapping apparatus is therefore also suitable for production rooms with limited space. The sealing of both film-wrapped side edges of the article by the sealing device in the sealing plane keeps on the one hand the processing time and on the other hand the space requirement of the film-wrapping apparatus low, as the article does not have to be turned or lifted for one or more sealing steps. As the grippers only grip the film at its opposite corners and pull and hold it from the supply position to the sealing position, there is no need for a complex and space-consuming mechanism as used for example with articulated robot arms. Furthermore, a certain amount of tightening of the film takes place, thus preventing kinks and folds of the film in the article arranged in the sealing position. Another advantage of the simple design of the grippers and the sealing device is that these components require little maintenance due to their simplicity. Due to the sealing of the side edges of the article, multiple layers of the film on the article are avoided, since protruding portions of the film do not have to be turned over. Since the respective article is precisely film-wrapped, additional positioning or fixing devices are not required.

Furthermore, the invention relates to a method for operating a film-wrapping apparatus. In the method, an article to be film-wrapped is conveyed by means of a conveying device through a film-wrapping channel of the film-wrapping apparatus. Film for film-wrapping the article is provided by a film-supply device arranged above the film-wrapping channel. At least two movably arranged grippers in a supply position grip the film supplied by the film-supply device at two opposite corners. The grippers holding the film are moved from the supply position into a sealing position, and the grippers in the sealing position are arranged in a sealing plane and essentially at the height of an upper side of the conveying device. The article to be film-wrapped is moved by means of the conveying device until a first front face of the article is arranged in the sealing plane. The film is folded at side edges of the first front face of the article by the grippers arranged in sealing position and holding the film, and film projections are produced. The film is sealed in a first sealing step by means of a sealing device at both side edges of the article in the sealing plane.

It is therefore the further object of the invention to specify a method by which the disadvantages mentioned can be avoided, by which a simple, space-saving and fully automatic film-wrapping of articles can be achieved.

According to the invention this is achieved by the features of the present technology.

The advantages of the method correspond to the advantages of the apparatus.

The subclaims relate to further advantageous designs of the invention.

Express reference is hereby made to the wording of the claims, whereby the claims are inserted at this point by reference in the description and are deemed to be reproduced verbatim.

BRIEF DESCRIPTION OF THE DRAWINGS

The invention is described in more detail with reference to the enclosed drawings, in which only preferred embodiments are shown by way of example, wherein:

FIG. 10 shows a preferred embodiment of the film-wrapping apparatus with an article disposed on the conveyor in axonometric view;

FIG. 11 shows another preferred embodiment of the film-wrapping apparatus in axonometric view;

DETAILED DESCRIPTION

Figure 1A:
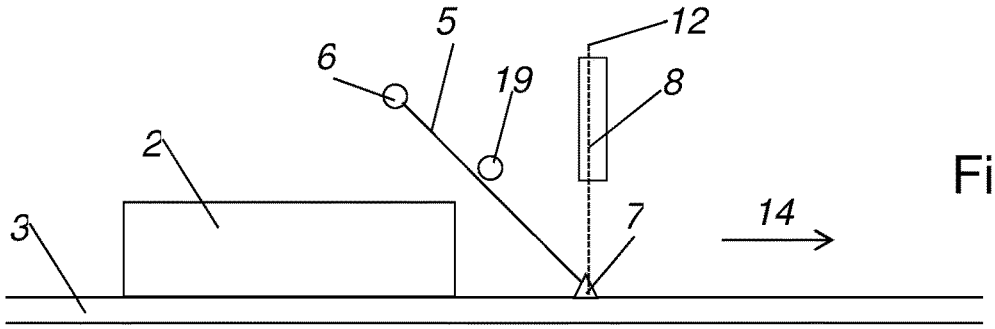
FIGS. 1*a*-1*e* show a schematic representation of individual method steps in side view.
Figure 1B:
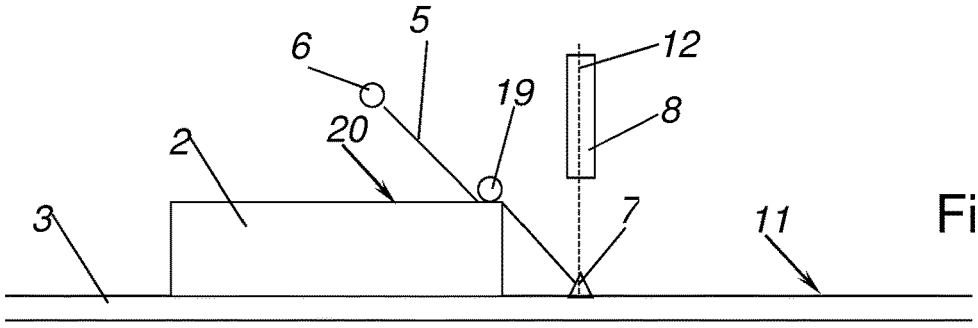
Figure 1C:
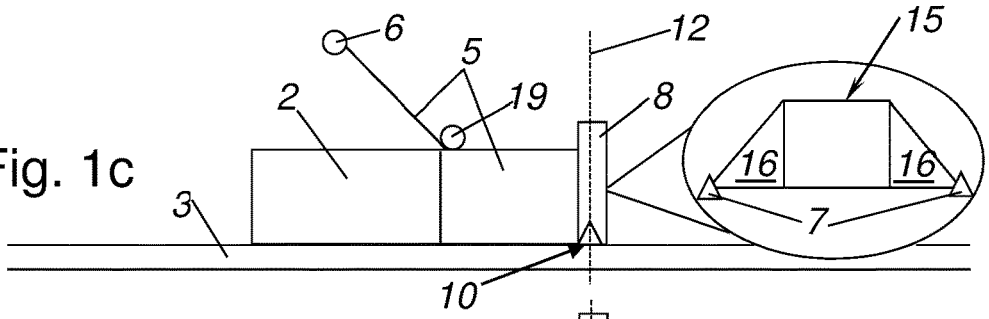

FIGS. 1*a* to 13 show at least parts of preferred embodiments of a film-wrapping apparatus 1 for the automatic film-wrapping of articles 2 comprising a conveying device 3, for conveying an article 2 through a film-wrapping channel 4 of the film-wrapping apparatus 1, wherein the film-wrapping apparatus 1 has a film-supply device 6 arranged above the film-wrapping channel 4—as seen in the operating position—for supplying film 5 for film-wrapping the article 2, wherein the film-wrapping apparatus 1 further comprises at least two movably arranged grippers 7 and a sealing device 8. In FIGS. 2 to 10, not all features are provided with reference numerals.

Figure 8:
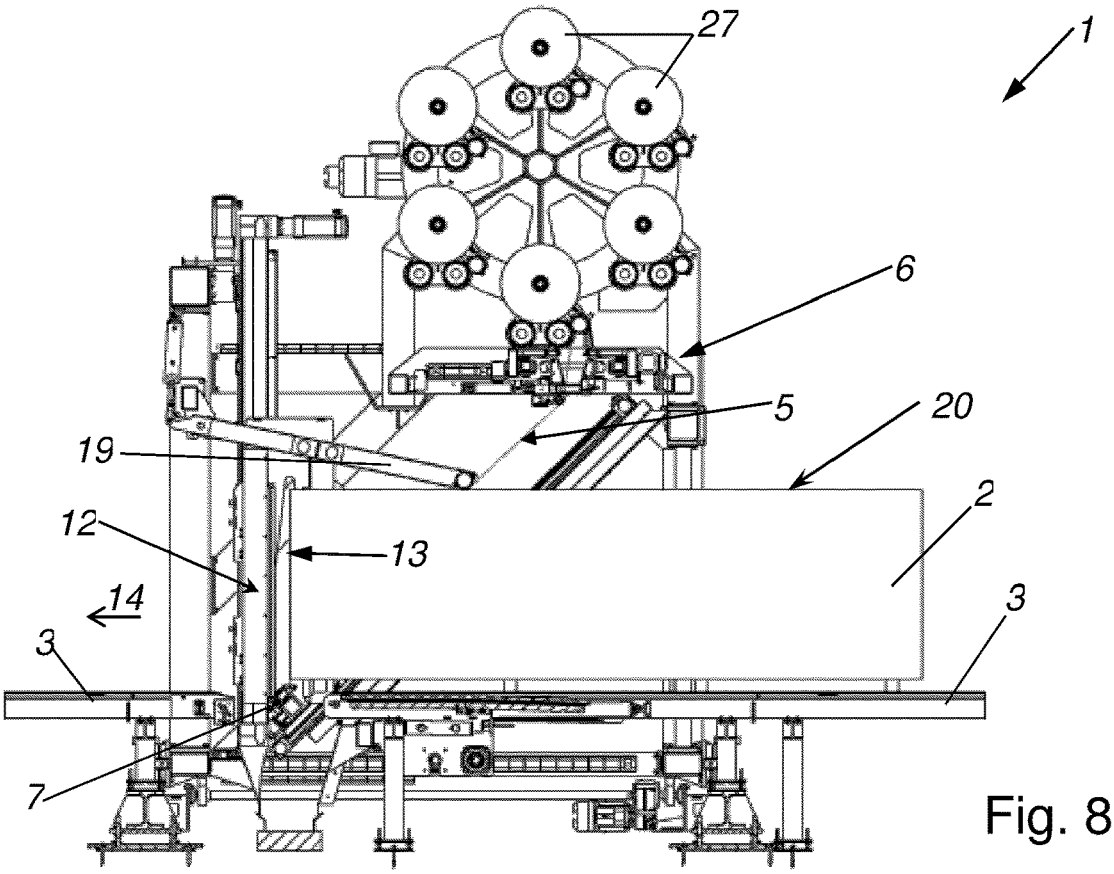
FIG. 8 shows the section along line A-A in FIG. 3 with an article disposed on the conveyor.

The film-wrapping apparatus 1 is used to cover or sheath articles 2 with film 5 in order to protect the articles 2 from external environmental influences. The word articles 2 refers to any kind of piece goods, but in particular to stacks of articles 2 and especially preferably to sawn timber stacks. The conveying device 3 conveys an article 2 through the film-wrapping channel 4 of film-wrapping apparatus 1 in a conveying direction 14. The speed of conveying the article 2 is adjustable. The film-wrapping channel 4 is the area where the articles 2 are film-wrapped. The film-wrapping channel 4 can also be seen as the volume which is limited by the conveying device 3 and the film-supply device 6. The film 5 can be made of a plastic such as polyethylene or a tear-resistant fabric. In the operating position, the film-supply device 6 is located above the film-wrapping channel 4, as shown in FIG. 8 by way of example. The article 2 is wrapped with the film 5, in particular on five sides. More precisely, the article 2 is wrapped with the film 5, in particular on the two side faces, on the two front faces 15, 17 and on the upper side 20. The term operating position means that the film-wrapping apparatus 1 is set up ready for operation and is not tilted at an angle, as might be the case, for example, in a transport condition during transport.

FIGS. 1*a*-1*e* show a schematic exemplary representation of individual method steps, wherein an article 2 is moved through the film-wrapping channel 4 in conveying direction 14 and film-wrapped. In the sealing plane 12, a film projection 16, in particular triangular and double-layer film projection 16, is respectively sealed at the side edges of the respective two front faces 15, 17 of the article 2 by the sealing device 8, as shown by way of example in the highlighted front views of the respective front faces 15, 17 of the article 2 in FIG. 1*c* and FIG. 1*e*.

Figure 4:
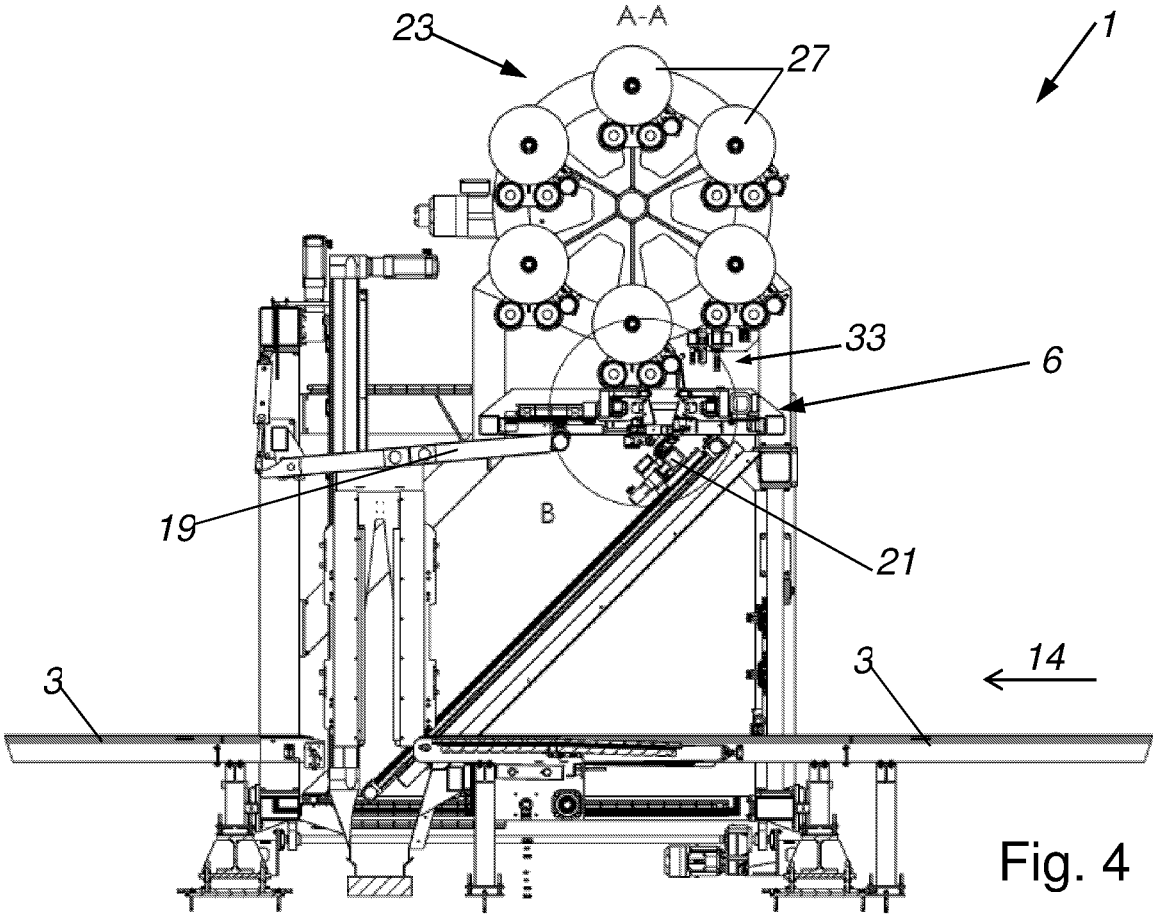
FIG. 4 shows the section along the line A-A in FIG. 3.
Figure 5:
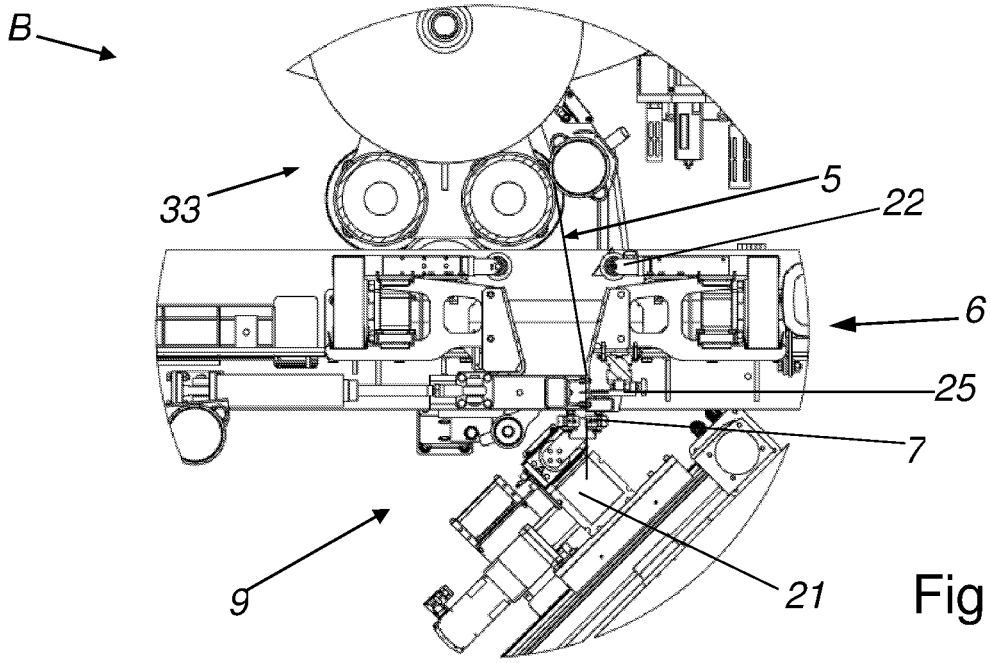
FIG. 5 shows the detail B of FIG. 4 in enlarged view.

The film-wrapping apparatus 1 comprises at least two movably arranged grippers 7. The grippers 7 can have at least one, preferably more than one clamping device or tongs for gripping the film 5. At least one gripper 7 can also have a clamping bar for gripping the film. The film-supply device 6 provides the film 5 for the film-wrapping of the articles 2. The sealing device 8 seals the film 5 to the article 2. The grippers 7 grip the film 5 at opposite corners in the supply position 9. The supply position 9 can be seen in relation to the grippers 7 as the position in which the grippers 7 are spatially closest to the film-supply device 6 and in which the film-supply device 6 prepares the film 5 for the grippers 7 ready for transfer, as shown in FIG. 4 and FIG. 5 as an example. FIG. 5 also shows an example of how a gripper 7 grips the film 5 provided by the film-supply device 6. In this case, the gripper 7 is arranged on a moving device 21.

The grippers 7 are designed to pull the film 5 from the supply position 9 to a sealing position 10. In sealing position 10, the grippers 7 are spatially the farthest away from the film-supply device 6. In sealing position 10, the grippers 7 are further arranged in the sealing plane 12 and essentially at the height of an upper side 11 of the conveying device 3, which is illustrated as an example in FIG. 8. The sealing plane 12 is the level in which the film 5 is sealed to the article 2 at, in particular, two side edges 13 of the article 2 covered with film 5. The sealing plane 12 can be regarded as an imaginary plane which is arranged parallel to the front face 13 of the article 2, in particular in a fixed position. The upper side 11 of the conveying device 3 is defined as that side of the conveying device 3 on which the article 2 is arranged in the operating condition, which can be seen as an example in FIG. 10.

It is provided that the at least two grippers 7 are arranged so as to be predeterminably movable between the supply position 9 and the sealing position 10, wherein the grippers 7 are designed to grip the film supplied by the film-supply device 6 at two opposite corners in the supply position 9 and to pull it from the supply position 9 to the sealing position 10 and hold it, wherein the grippers 7 in the sealing position 10 are arranged in a sealing plane 12 and essentially at the height of the upper side 11 of the conveying device 3, and that the sealing device 8 is designed to seal both side edges 13 of the article 2 arranged in the sealing plane 12 and covered with film 5.

For cuboid article 2, the sealing plane 12 is essentially normal to the conveying device 3 and transverse to the conveying direction 14. The grippers 7 are arranged in the sealing position 10 in the sealing plane 12 and essentially at the height of the upper side 11 of the conveying device 3 to ensure that the film 5 essentially reaches a lower edge of the article 2 during sealing.

Furthermore, a method is provided for operating a film-wrapping apparatus 1, wherein article 2 to be film-wrapped is conveyed by means of a conveying device 3 through a film-wrapping channel 4 of the film-wrapping apparatus 1, wherein film 5 for film-wrapping the article 2 is provided by a film-supply device 6 arranged above the film-wrapping channel 4, wherein at least two movably arranged grippers 7 in a supply position 9 grip the film 5 supplied by the film-supply device 6 at two opposite corners, wherein the grippers 7 holding the film 5 are moved from the supply position 9 to a sealing position 10, wherein the grippers 7 are arranged in the sealing position 10 in a sealing plane 12 and essentially at the height of an upper side 11 of the conveying device 3, wherein the article to be film-wrapped 2 is moved by means of the conveying device 3 until a first front face 14 of the article 2 is arranged in the sealing plane 12, wherein the film 5 is folded at side edges 13 of the first front face 15 of the article 2 by the grippers 7, which are arranged in sealing position 10 and hold the film, and film projections 16 are produced, wherein the film 5 is sealed in a first sealing step by means of a sealing device 8 at both side edges 13 of the article 2 in the sealing plane 12.

The conveying device 3 extends in particular over the length of the film-wrapping channel 4 and conveys the article 2 through the film-wrapping channel 4. The conveying device 3 can preferably be designed as a conveyor belt, especially preferably as a roller conveyor or as a longitudinal conveyor with telescopic conveyor and can extend over the length of the film-wrapping channel 4. The film-wrapping apparatus 1 can preferably have means for variable height adjustment of the conveying device 3, so that variable staggered timber dimensions or transport without staggered timber can be taken into account. The article 2 is moved by means of the conveying device 3 until the first front face 14 of the article 2 is located in the sealing plane 12. In the case of a cube-shaped or cuboid article 2, both side edges 13 of the first front face 14 of the article 2 are correspondingly arranged in the sealing plane 12. In particular, both side edges 13 can be sealed simultaneously in the sealing plane 12 by means of the sealing device 8.

This has the advantage that the entire film-wrapping process proceeds in an uncomplicated and fully automatic manner. This relieves the operating personnel, as no human work steps are required for the film-wrapping of articles 2 and correspondingly, personnel costs can be saved. Furthermore, a simple, reliable and fully continuous operation of the film-wrapping apparatus 1 is made possible. Due to the automation, the efficiency of the film-wrapping apparatus 1 is also increased. Another advantage is that no fixing elements such as staples or nails are required to position and/or fix the film 5 to the article, which results in optically appealing results of high quality. Since the available space in various plants and production rooms is often very limited, another advantage of the film-wrapping apparatus 1 is that the film-wrapping apparatus 1 can be shorter in its dimensions than the article 2 to be film-wrapped. Due to the space-saving design, the film-wrapping apparatus 1 is therefore also suitable for production rooms with limited space. By sealing both side edges 13 of the article 2 sheathed by film 5 by the sealing device 8 in the sealing plane 12, the processing time on the one hand and the space requirement of the film-wrapping apparatus 1 on the other hand are kept low, as the article and/or the sealing device 8 does not have to be turned or lifted for one or more sealing steps. As the grippers 7 only grip the film 5 at its opposite corners and pull and hold it from the supply position 9 to the sealing position 10, a complex and space-consuming mechanism, as it is used for example with articulated robot arms, can be dispensed with and a certain amount of tightening of the film 5 is also automatically achieved, thus avoiding kinks and folds of the film on the article 2 arranged in the sealing position 10. Another advantage of the simple design of the grippers 7 and the sealing device 8 is that these components require little maintenance due to their simplicity. Due to the sealing of the side edges 13 of the article 2, a multiple layer of the film 5 on the article 2 is avoided, since film projections 16 do not have to be folded over. Since the respective article 2 is precisely film-wrapped, additional positioning or fixing devices are not required.

By arranging the first front face 14 of the article 2 in the sealing plane 12 and by the grippers 7 arranged in the sealing position 10 and holding the film, the film 5 is folded at the side edges 13 of the first front face 15 of the article 2. These especially triangular-shaped film projections 16 can be sealed off during the first sealing step by means of the sealing device 8 and thus removed, which is shown by way of example in FIG. 1*c*.

Figure 1D:
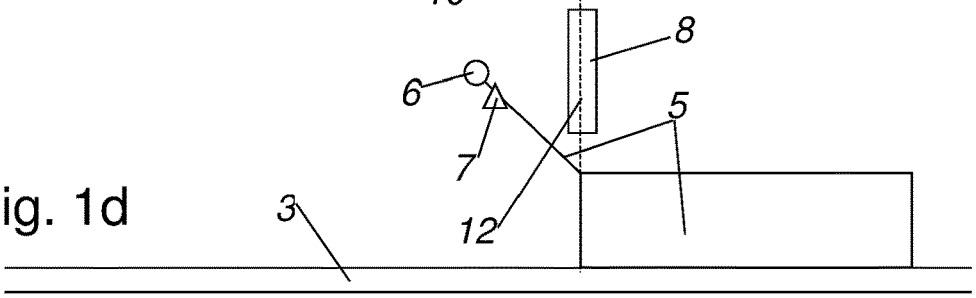
Figure 1E:
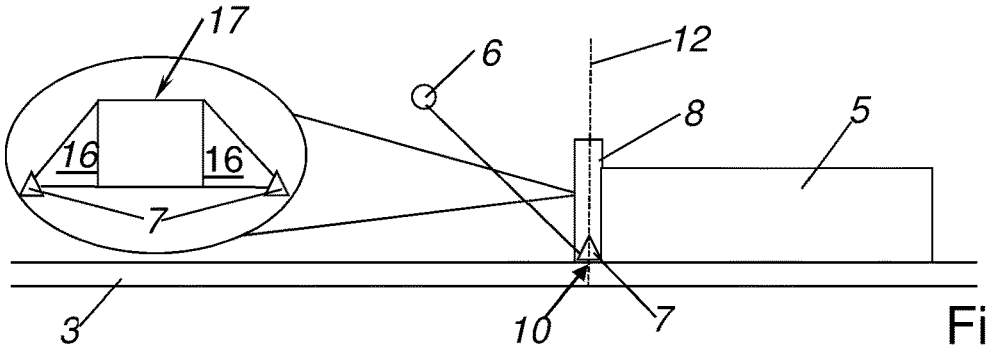

It may be provided that the film 5 is folded at the side edges 13 of the second front face 17 of the article 2 by the movement of the second front face 17 into the sealing plane 12 and by the movement of the grippers 7 holding the film 5 into the sealing position 10, and the sealing device 8 seals off the film projections 16, in particular triangular projections 16 resulting from the folding of the film 5, thus ensuring a uniform film-wrapping of the article 2, which can be seen as an example in FIG. 1*e*. Preferably, the sealing device 8 seals both film projections 16 simultaneously.

It may be provided that the film-wrapping apparatus 1 comprises at least one sensor that determines the dimensions of the article 2, thus eliminating the need for manual input of the dimensions of the article 2. The dimensions of the article 2 to be film-wrapped are important information regarding the length and width of the required film 5 to film-wrap the article 2 on five sides, in particular on the upper side 20, on both side faces and on both front faces 15, 17.

In order to further reduce the space requirement of the film-wrapping apparatus 1, it can be provided that the film-supply device 6 and the grippers 7 are arranged on a common frame. The frame itself can be arranged on an alignment unit that can be moved normally to the conveying direction 14, whereby the frame can be aligned or centered with respect to the respective position of the article 2 on the conveying device 3.

Figure 6:
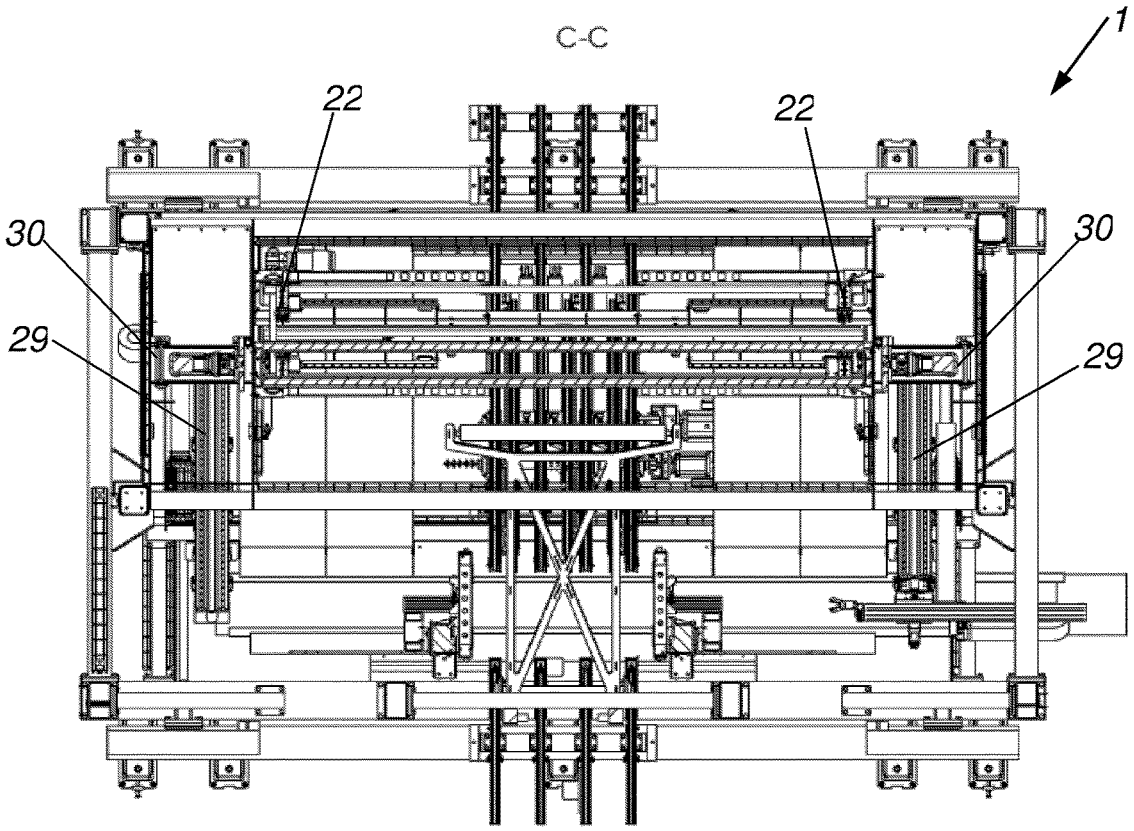
FIG. 6 shows the section along the line C-C in FIG. 3.

It may also be provided that the film-wrapping apparatus 1 comprises at least one horizontal positioning element 31 and/or at least one vertical positioning element 32 in order to position the sealing device 8 in the sealing plane 12 according to the dimensions of the article 2, in particular the dimensions of the front faces 15, 17 of the article 2, which can be seen as an example in FIG. 6. The at least one horizontal positioning element 31 positions the sealing device 8 according to the width of the article 2. The at least one vertical positioning element 32 positions the sealing device 8 according to the height of the article 2. The at least one horizontal positioning element 31 and the at least one vertical positioning element 32 are shown by way of example in FIG. 10.

Figure 9:
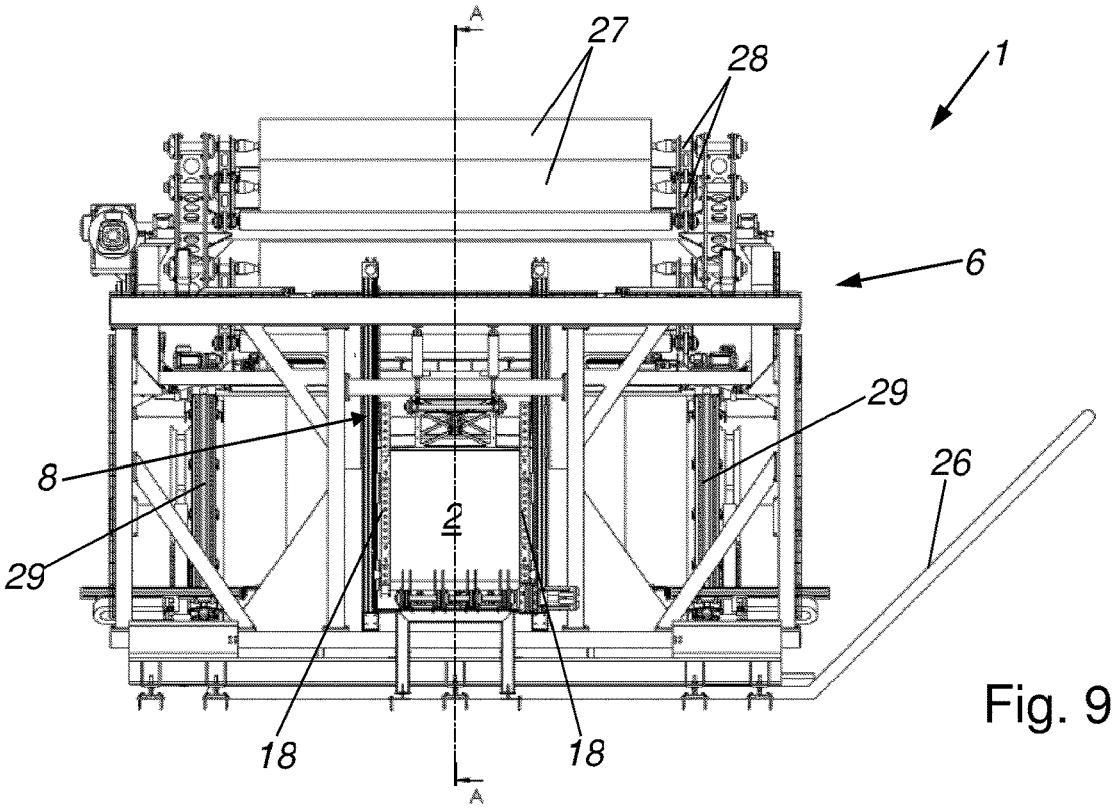
FIG. 9 shows a preferred embodiment of the film-wrapping apparatus with an article disposed on the conveyor in front view.
Figure 12:
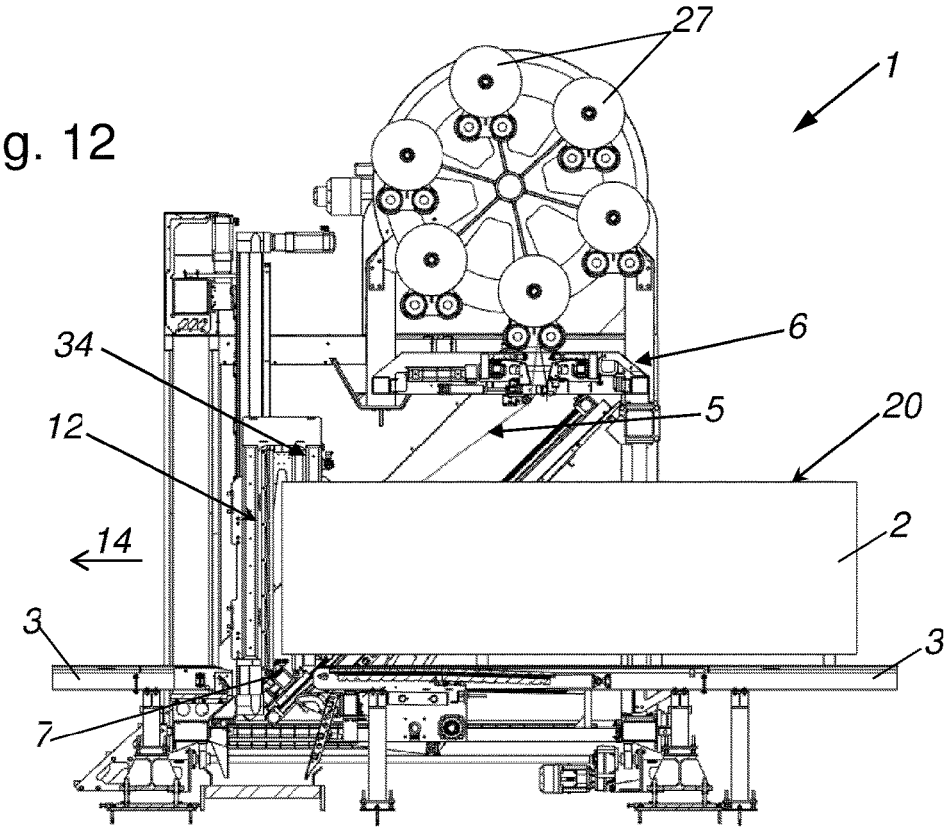
FIG. 12 shows the further preferred embodiment of the film-wrapping apparatus in side view.
Figure 13:
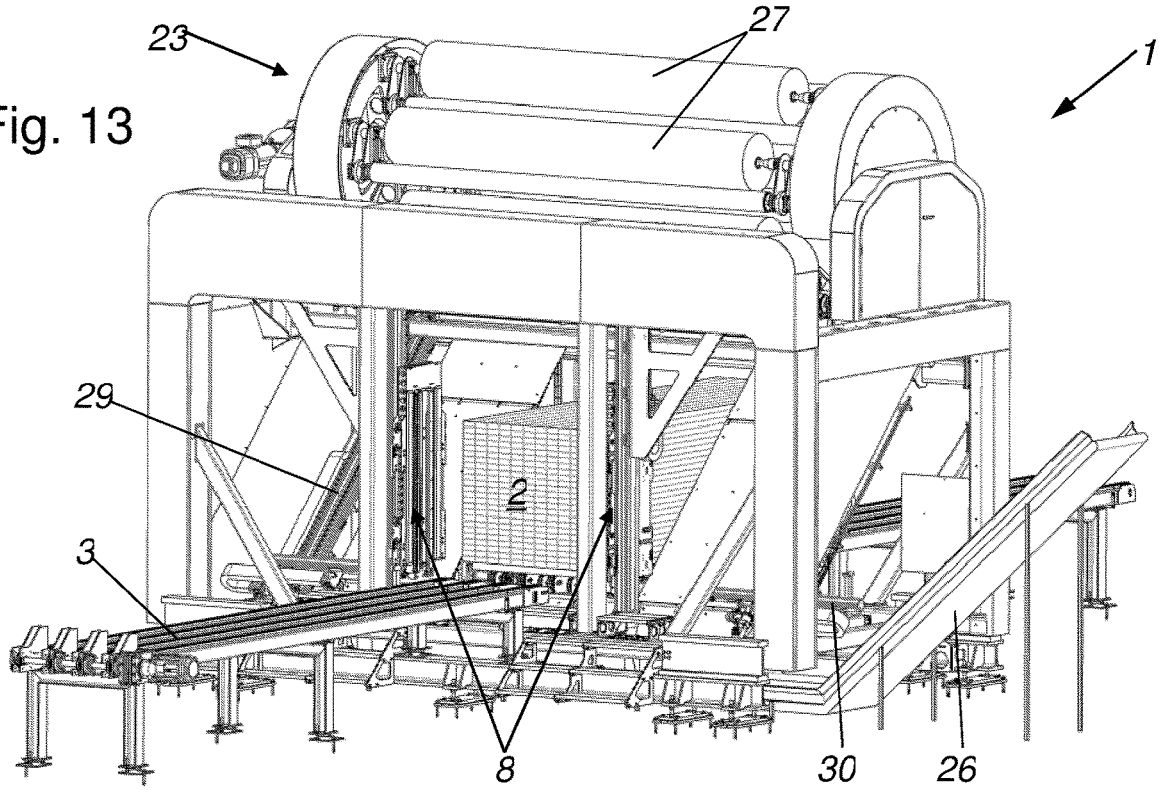
FIG. 13 shows the further preferred embodiment of the film-wrapping apparatus with an article disposed on the conveyor in axonometric view.

Preferably, it may be provided that the sealing device 8 has at least one, in particular two, mutually spaced apart sealing bars 18, which is shown as an example in FIG. 9. Thus, the sealing device 8 can simultaneously seal both side edges 13 of the first front face 15 of the article 2, which on the one hand saves processing time and on the other hand enables reliable and uniform sealing results due to the simple design.

It may be provided that the grippers 7 in sealing position 10 are arranged in a sealing plane 12 that is essentially normal to the conveying direction 14. The sealing plane 12 can also be defined essentially as the plane which is defined by the grippers 7 in sealing position 10 and the front face 15, 17 of the article 2 when they are arranged in a line.

In particular, it may be provided that the film-wrapping apparatus 1 has a single sealing device 8 which is movably arranged in the sealing plane 12. It may also be provided that the film-wrapping apparatus 1 comprises two or more than two sealing devices 8. The advantage of having only one sealing device 8 is that the film-wrapping apparatus 1 requires only a simple control system to control the one sealing device 8.

However, it may also be provided that the at least one sealing device 8 has at least one, in particular several, movable parts for sealing the film 5, which is held in sealing position 10 by the grippers 7, on the article 2 to be film-wrapped. Thus, the sealing plane 12 can be selectively adjusted with respect to the inclination of the front face 13, 17 of the article in case of an article 2 which is not cuboid, for example. It may be especially preferably provided that at least one sealing bar 18 is arranged in sealing plane 12 so that it can be moved in a predetermined way.

It may also be preferably provided that the at least one, in particular at least two, sealing bars 18 are provided with a film clamp to reduce the tension in the film during the sealing process. The clamping is located in particular between the at least one sealing bar 18 and the transported articles 2.

Furthermore, it may preferably be provided that the film-wrapping apparatus 1 comprises at least one movably mounted hold-down device 19, in particular a hold-down roller, in order to press the film 5 onto an upper side 20 of the article 2, thus achieving a smoother and more even surface on the upper side 20 of the article 2. Furthermore, pressing the film down on the surface of the article 2 creates a certain tension in the film 5, which keeps the kinks and edges of the film 5 on the article 2 at a low level.

In another preferred embodiment it may be provided that the film-wrapping apparatus may comprise air nozzles 34 to press the film 5 onto the upper side 20 of the article 2 using air pressure. The other preferred embodiment is shown as an example in FIGS. 11 to 13.

In particular, the air nozzles 34 can be designed as alignable air nozzles 34, whereby the respective air flow of the respective air nozzle 34 can be easily adapted to the geometric shape of the article 2 in order to effectively press the film 5 onto the upper side 20 of the article 2.

It may also preferably be provided that the air flow generated by the air nozzles 34 and/or the outlet speed of the air is/are adjustable, in particular infinitely variable.

The air nozzles 34 can preferably be arranged in the area of the sealing device 8, in particular thereon.

However, it may also be preferably provided that the film-wrapping apparatus 1 comprises at least one side holder for pressing the film 5 laterally against the article 2, thus achieving a smoother and more uniform surface of the film 5 on the side faces of the articles 2.

It may be preferably provided that at least one gripper 7 is arranged at a moving device 21. The moving device 21 can preferably comprise at least one linear guide, which runs along a longitudinal axis 29, which extends from the supply position 9 to the sealing position 10. Accordingly, it may be provided that the grippers 7—in operating position—are arranged on the longitudinal axis 29 at an angle to the conveying direction 14 so as to be predeterminably movable by linear guides and that the grippers 7 are guided linearly between the supply position 9 and the sealing position 10.

It may also be provided that the moving device 21 has at least one transverse axis 30, which may preferably be designed as a belt axis with linear guides, as shown as an example in FIG. 10. Particularly preferably, the moving device 21 has at least one linear guide along the longitudinal axis 29 and one belt axis with linear guides along the transverse axis 30.

A linear guide is preferably arranged in each case along one longitudinal axis 29 on each side of the film-wrapping channel 4. It is particularly preferred to have one moving device 21 on each side of the film-wrapping channel 4.

Furthermore, it may be provided that the moving device 21 comprises a drive, preferably a linear motor or a toothed belt drive.

The grippers 7 are particularly designed to grip the film 5 in the supply position 9 and to hold the film 5 in the sealing position 10. A gripper 7 can have two or more clamping elements, such as clamps, which it can open and close, or it can be designed as a clamping rail or a clamping bar which can be opened and closed.

However, it may also be preferably provided that the grippers 7 are pivoted between the supply position 9 and the sealing position 10. For this purpose, the grippers 7 can be pivotably mounted.

It may be provided that the film-supply device 6 comprises at least one horizontal cutting device 25 for cutting the film 5. By cutting the film 5 horizontally, the length of the film 5 can be adapted to the length of the article 2.

Furthermore, it can be preferably provided that the film-supply device 6 comprises at least one vertical cutting device 22 for cutting the film 5. Due to the vertical cutting of the film 5, many different films 5 can be used, as they can be exactly adapted to the dimensions of the article 2. This enables the film 5 to be cut exactly to the dimensions of the article 2.

Figure 2:
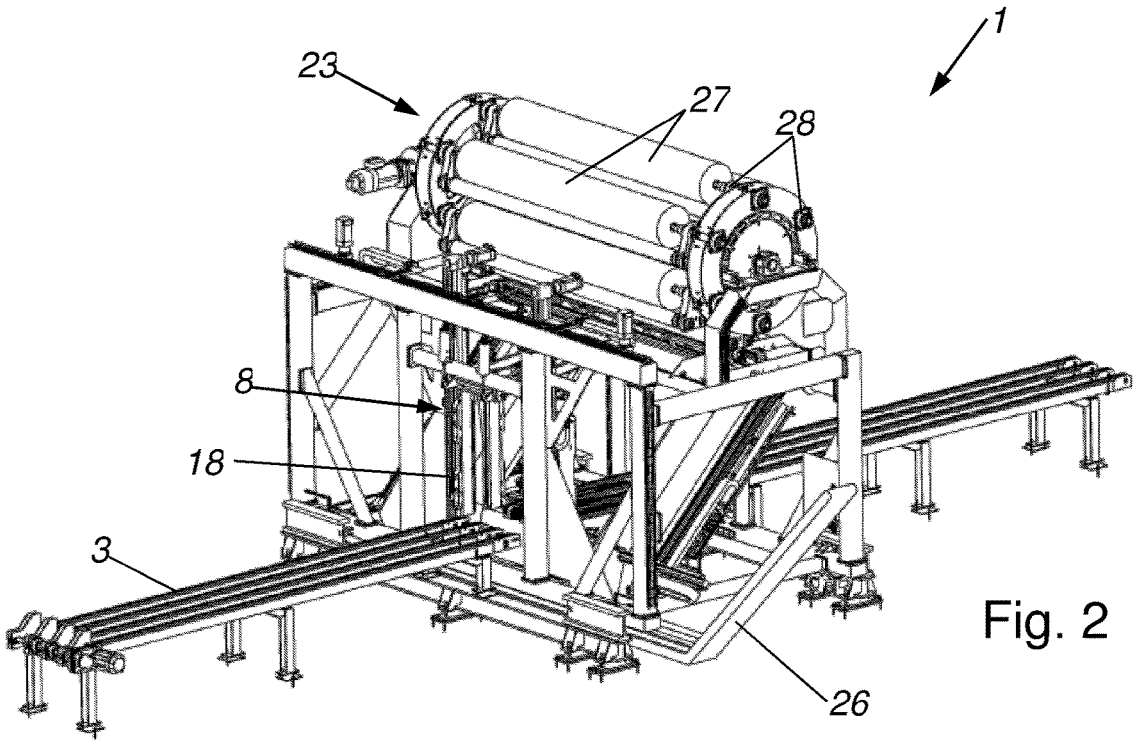
FIG. 2 shows a preferred embodiment of the film-wrapping apparatus in axonometric view.
Figure 7:
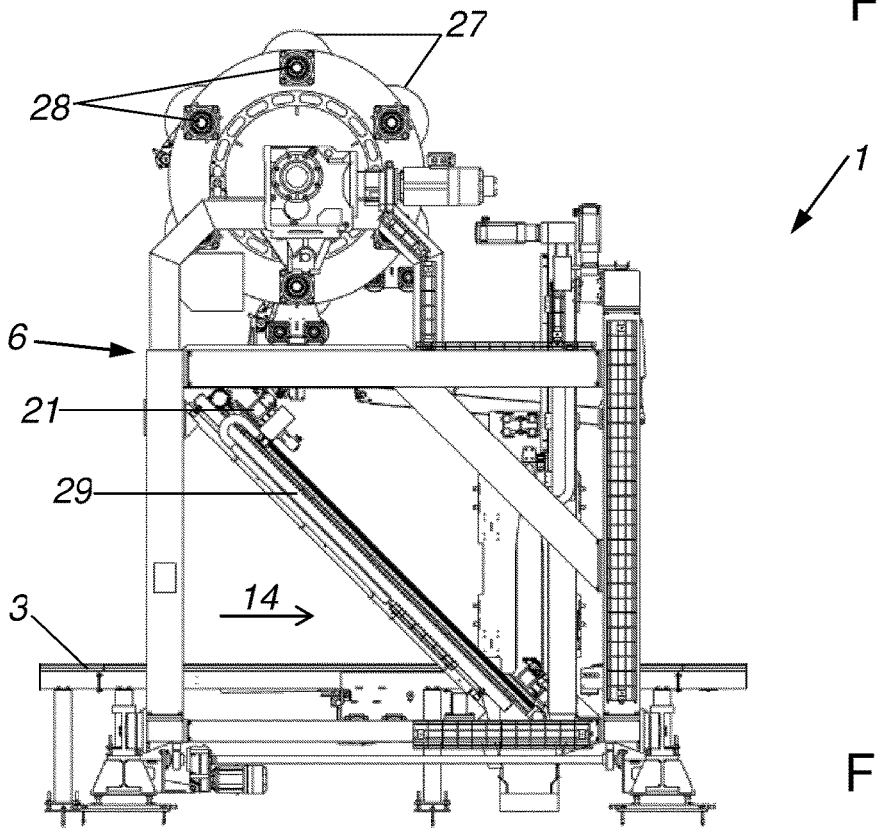
FIG. 7 shows a preferred embodiment of the film-wrapping apparatus in side view.

It may be particularly preferably provided that the film-wrapping apparatus 1 has a film turret 23, which comprises a plurality of film holders 28 and a pivotable roll-off drive 24. Preferably, the film turret 23 has at least four, in particular at least six, preferably six, film holders 28 for at least four, in particular at least six, preferably six, films 5, as shown in FIG. 2 and FIG. 7 as examples Films 5, in particular film rolls 27, can thus be stored in the film holders 28 of the film turret 23, which saves space on the one hand and enables fully automatic changing between different films 5 of different materials, thicknesses or basic dimensions on the other hand. Thus, for example, films 5 of different widths can be stored in the film turret 23, which can be selected selectively for articles 2 of different dimensions, thus reducing film waste and saving costs.

It may be preferably provided that the positioning of the film 5 in the film turret 23 into a roll-off position 33 and the clamping of the film 5 from the film turret 23 to the film-supply device 6 takes place automatically by means of an inwardly pivotable roll-off drive 24. Furthermore, it may be provided that the film-wrapping apparatus 1 comprises a crane for loading the film turret 23 with films 5.

Figure 3:
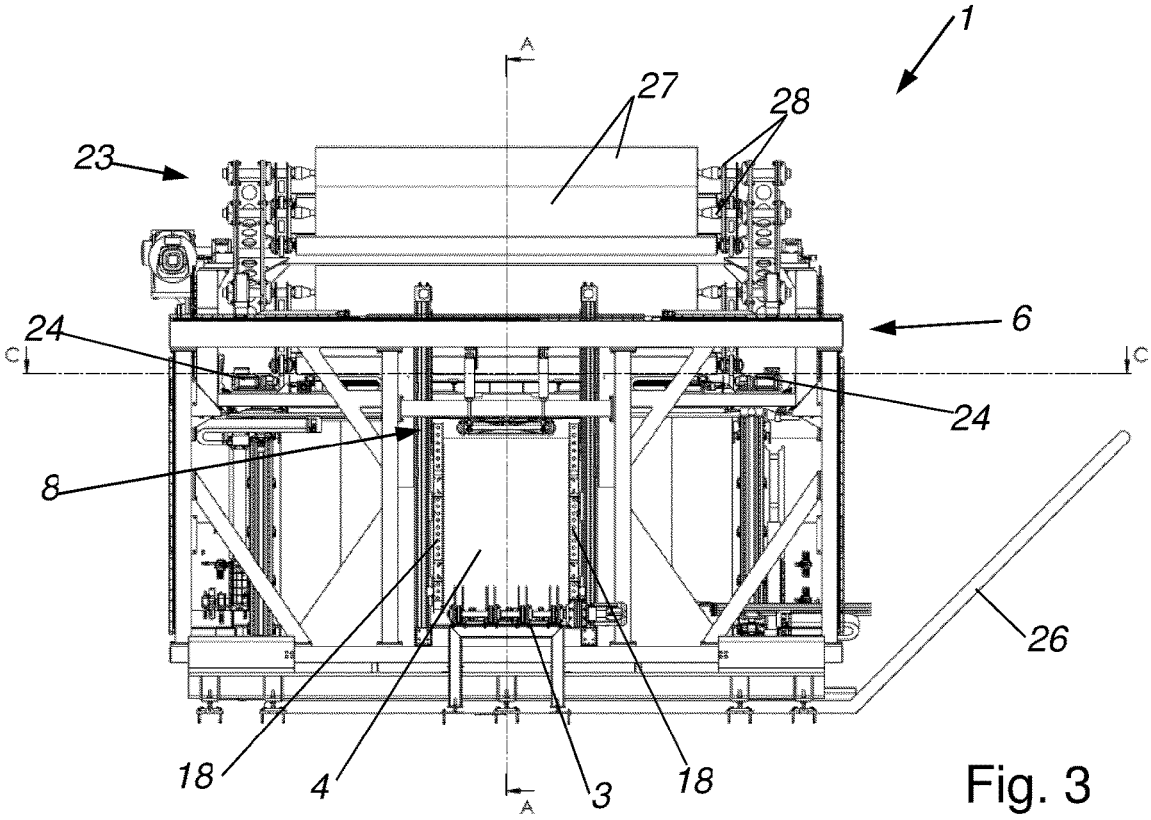
FIG. 3 shows a preferred embodiment of the film-wrapping apparatus in front view.

Furthermore, it may be preferably provided that the film-wrapping apparatus 1 has a film disposal device 26, which enables a fully automatic disposal of the sealed-off or cut-off excess film 16. The film disposal device 26 is preferably designed as a conveyor belt or as a movable holder and serves to automatically dispose of the excess film 16 which is sealed off or cut off in the first and/or second sealing step, as shown in FIG. 3 and in FIG. 9 as an example.

For the purpose of automation, it can be provided that the film-wrapping apparatus 1 comprises means for attaching a parcel label to the film-wrapped article 2.

It is particularly preferably provided that the film 5 is folded by the movement of the article 2 into the sealing plane 12 at the first front face 15 of the article 2. The grippers 7 hold the film 5 in the sealing position 10. When the article 2, or more precisely a first front face 15 of the article 2 is moved to the sealing position 10, the film 5 is tensioned, resulting in the particularly triangular folding of the film 5 with a double projection on the side edges 13 of the first front face 15 of the article 2.

In order to seal the film 5 at the second front face 17 of the article 2, it may be provided that the grippers 7 release the film 5 after the first sealing step and the article 2 is moved on in conveying direction 14 until a second front face 17 of the article 2 is arranged in the sealing plane 12, wherein the grippers 7 grip the film 5 in particular at the film-supply device 6 at opposite edges and the grippers 7 holding the film 5 are moved into the sealing position 10, wherein the grippers 7 arranged in sealing position 10 fold the film 5 at the side edges of the second front face 17 of the article 2 and produce film projections 16, wherein the film 5 is sealed in a second sealing step by means of the sealing device 8 at both side edges 13 of the second front face 17 of the article 2 in the sealing plane 12, as shown in the FIGS. 1*d* and 1*e* as an example. The film projections 16 are usually triangular and double-layered and they are preferably sealed simultaneously by the sealing device 8, in particular by two sealing bars 18, which saves time.

In order to achieve an optically appealing film-wrapping, it is also preferred that in the first and/or second sealing step the film projections 16 are separated from the film 5. It may be particularly preferably provided that the gripper arms 7 transfer the film projections 16 that accumulate in the first and/or second sealing step to the film disposal device 26.

In order to tension the film 5 at the article 2 accordingly and to avoid folds, it is preferably provided that the film 5 pulled by the grippers 7 from the supply position 9 to the sealing position 10 encloses with the conveying device 3 an angle of a minimum of 20°, in particular a minimum of 30°, preferably a minimum of 45°, and a maximum of 70°, in particular a maximum of 60° and particularly preferably a maximum of 50°.

It may also be provided that the longitudinal axis 29 preferably encloses an angle of a minimum of 20° and a maximum of 90°, particularly preferably between 30° and 60°, between the conveying device 3 and the film-supply device 6, or between the sealing position 10 and the supply position 9.

In order to achieve precise dimensioning of the film and correspondingly evenly shaped right-angled triangles of the film projections 16, which can be sealed off with corresponding accuracy by the sealing device 8, it is provided that the distance of the grippers 7 in the sealing position 10 to each other corresponds to the width of the film 5, in particular the sum of the lengths of the upper edge and both side edges of the article 2.

The invention claimed is:

1. A film-wrapping apparatus for automatic film-wrapping of articles, comprising:

a conveying device for conveying an article in a conveying direction through a film-wrapping channel of the film-wrapping apparatus;

a film-supply device for supplying film for film-wrapping the article, which film-supply device is arranged above the film-wrapping channel;

at least two movably arranged grippers, the at least two grippers being predeterminably movable between a supply position and a sealing position, the at least two grippers being adapted to grip the film supplied by the film-supply device in the supply position at two opposite corners, to pull the film from the supply position to the sealing position, and to hold said film; and a sealing device, the grippers in the sealing position being arranged in a sealing plane and substantially at a height of an upper side of the conveying device, the sealing device being adapted to seal the film on both side edges of the article arranged in the sealing plane and sheathed by the film.

2. The film-wrapping apparatus according to claim 1, wherein the sealing device has at least one spaced-apart sealing bars.

3. The film-wrapping apparatus according to claim 2, wherein the sealing device has two, spaced-apart sealing bars.

4. The film-wrapping apparatus according to claim 2, wherein at least a part of one of the sealing bars is arranged to be predeterminably movable in the sealing plane.

5. The film-wrapping apparatus according to claim 1, wherein the film-wrapping apparatus comprises air nozzles for pressing the film onto an upper side of the article.

6. The film-wrapping apparatus according to claim 1, wherein at least one of the grippers is arranged on a moving device, wherein the moving device comprises at least one linear guide.

7. The film-wrapping apparatus according to claim 1, wherein the grippers are arranged to be predeterminably movable horizontally in the conveying direction.

8. The film-wrapping apparatus according to claim 1, wherein the film-supply device comprises at least one vertical cutting device for cutting the film.

9. The film-wrapping apparatus according to claim 1, wherein the film-wrapping apparatus has a film turret comprising a plurality of film holders and a pivotable roll-off drive.

10. The film-wrapping apparatus according to claim 1, wherein the film-wrapping apparatus has a film disposal device.

11. A method for operating a film-wrapping apparatus, comprising:

conveying, in a conveying direction by a conveying device, an article to be film-wrapped through a film-wrapping channel of the film-wrapping apparatus;

providing film for film-wrapping the article by a film-supply device arranged above the film-wrapping channel;

gripping, by at least two movably arranged grippers in a supply position, the film supplied by the film-supply device at two opposite corners; and moving the at least two grippers holding the film from the supply position into a sealing position, the at least two grippers in the sealing position being arranged in a sealing plane and substantially at a height of an upper side of the conveying device;

wherein the article to be film-wrapped is moved by means of the conveying device until a first front face of the article is arranged in the sealing plane, wherein the film is folded at side edges of the first front face of the article by the at least two grippers arranged in the sealing position and holding the film, and film projections are produced, wherein the film is sealed in a first sealing step by means of a sealing device at both side edges of the article in the sealing plane.

12. The method according to claim 11, wherein the film is folded at the first front face of the article by a movement of the article into the sealing plane.

13. The method according to claim 11, wherein:

the at least two grippers release the film after the first sealing step and the article is moved on in the conveying direction until a second front face of the article is arranged in the sealing plane;

subsequently the at least two grippers grip the film at opposite edges and the at least two grippers holding the film are moved into the sealing position;

the at least two grippers arranged in the sealing position fold the film at the side edges of the second front face of the article and film projections are produced; and the film is sealed in a second sealing step by means of the sealing device at both side edges of the second front face of the article in the sealing plane.

14. The method according to claim 13, wherein in at least one of the first sealing step and the second sealing step the film projections are separated from the film.

15. The method according to claim 11, wherein the film pulled by the at least two grippers from the supply position into the sealing position encloses an angle of at least 20 degrees, and at most 70 degrees, with the conveying device.

16. The method according to claim 15, wherein the angle enclosed by the film being pulled by the at least two grippers from the supply position into the sealing position is at least 30 degrees.

17. The method according to claim 16, wherein the angle enclosed by the film being pulled by the at least two grippers from the supply position into the sealing position is at least 45 degrees.

18. The method according to claim 15, wherein the angle enclosed by the film being pulled by the at least two grippers from the supply position into the sealing position is at most 60 degrees.

19. The method according to claim 18, wherein the angle enclosed by the film being pulled by the at least two grippers from the supply position into the sealing position is at most 50 degrees.

20. The method according to claim 11, wherein a distance between the at least two grippers in the sealing position corresponds to a width of the film.

21. The method according to claim 20, wherein the distance between the at least two grippers in the sealing position corresponds to a sum of lengths of an upper edge and both side edges of the article.

* * * * *